US010213701B2

(12) United States Patent
Howard

(10) Patent No.: US 10,213,701 B2
(45) Date of Patent: Feb. 26, 2019

(54) PASSENGER RESTRAINT FOR UPRIGHT, STRADDLE-TYPE SEATING IN AN AMUSEMENT PARK RIDE VEHICLE

(71) Applicant: DISNEY ENTERPRISES, INC., Burbank, CA (US)

(72) Inventor: Derek Howard, Pasadena, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 661 days.

(21) Appl. No.: 14/521,139

(22) Filed: Oct. 22, 2014

(65) Prior Publication Data

US 2016/0114749 A1 Apr. 28, 2016

(51) Int. Cl.

| | |
|---|---|
| ***B60R 21/02*** | (2006.01) |
| ***A63G 31/00*** | (2006.01) |
| ***A63G 7/00*** | (2006.01) |

(52) U.S. Cl.

CPC ..... *A63G 31/00* (2013.01); *A63G 7/00* (2013.01)

(58) Field of Classification Search

CPC ..... A63G 31/00; A63G 7/00

USPC ..... 472/43, 46, 47

See application file for complete search history.

(56) References Cited

U.S. PATENT DOCUMENTS

| | | | | |
|---|---|---|---|---|
| 2,292,414 | A * | 8/1942 | Vernon | A47C 1/033 244/122 R |
| 5,100,173 | A * | 3/1992 | Kudler | A63G 25/00 180/271 |
| 5,238,265 | A * | 8/1993 | Duce | B60R 21/02 280/751 |
| 6,287,211 | B1 * | 9/2001 | Bolliger | A63G 7/00 297/466 |
| 7,204,559 | B2 * | 4/2007 | Berra | B60R 21/02 105/149.2 |
| 7,677,671 | B2 * | 3/2010 | Steininger | A63G 7/00 297/487 |
| 2006/0202542 | A1 * | 9/2006 | Pribonic | B60R 21/00 297/467 |
| 2008/0149017 | A1 * | 6/2008 | Blum | B60R 21/02 114/343 |

* cited by examiner

*Primary Examiner* — Vishu K Mendiratta
(74) *Attorney, Agent, or Firm* — Marsh Fischmann & Breyfogle LLP; Kent A. Lembke

(57) ABSTRACT

A ride vehicle with upright, straddle-type passenger seating that includes a passenger restraint system. This restraint system includes a lap bar assembly and a lap bar pivotal mount element pivotally supporting the lap bar assembly within the vehicle body to pivot about a rotation axis passing through the vehicle body between the seat pan and the front end of the vehicle body. The lap bar assembly may include a lap bar along with side and front leg shields that contain a passenger's legs within the vehicle. The lap bar assembly is rotatable as a unit about the rotation axis, in a forward portion of the vehicle body, from a disengaged position to an engaged position. In the disengaged position, the leg shields are moved forward away from an access to the seat pan, and, in the engaged position, the passenger's legs are blocked from lateral and forward movement.

20 Claims, 9 Drawing Sheets

PASSENGER RESTRAINT FOR UPRIGHT, STRADDLE-TYPE SEATING IN AN AMUSEMENT PARK RIDE VEHICLE

BACKGROUND

1. Field of the Description

The present invention relates, in general, to amusement park rides and passenger restraints in such rides and other implementations, and, more particularly, to a passenger restraint system for an amusement park ride in which the passengers are provided with upright and straddle-type seating (e.g., as if riding a motorcycle or similar vehicle). The restraint system includes a lap bar assembly configured to provide both front (or longitudinal) constraint and side constraint of a ride passenger's legs when the lap bar assembly is placed in (or operated to be in) the down or engaged position.

2. Relevant Background

Passenger restraints such as lap bars are used throughout the amusement park industry to safely and securely restrain passengers within a seat of a vehicle. For example, many amusement park rides provide themed rides in which vehicles ride along on one or more tracks, and the passengers are restrained from standing up or leaving the vehicle by a lap bar that is positioned across their laps or provided over their shoulders as an overhead or similar restraint.

During loading in some rides, the lap bar is positioned against the passenger by a ride operator that is pressing a foot lever to allow adjustment of the position of the lap bar relative to the passengers. Once in position, the operator releases the foot lever or pedal to lock the lap bar in this ride or down position. When the ride is over, the vehicle may pass over a portion of the track with a release mechanism causing the lap bar to become unlocked from the ride position. The lap bar then may spring to an open or up position. In other lap bar designs, the lap bar, which may be U-shaped or T-shaped, may be pulled by the passenger toward their lap from a forward position or from a rearward position over their heads (a lap bar restraint with a rear rotating assembly). Once in a securing position close to the passenger's lap, the lap bar assembly may be locked or engaged in position until the end of the ride.

There are a number of concerns with these conventional lap bar assemblies when applied to ride vehicles that utilize upright, straddle-type seating of passengers such as rides that simulate motorcycles, futuristic bikes, and the like. For example, one goal of ride designers is to ensure the passengers' safety throughout the ride, and the ride vehicle may be designed with a body that provides fixed and rigid shields to provide forward and side protection and containment of the passengers' legs. In such cases, the passengers typically have to step over the straddle-type seat and slide their legs into the fixed leg shields or constraints. Then, the lap bar, often a T-shaped bar or an over-the-shoulder bar, is pulled into place. While providing leg constraint and passenger safety, the use of rigid leg constraints often results in a bulky ride that feels "closed" and is heavily shrouded. Such ride vehicles also may produce slow passenger loading. Some vehicle rides also include rigid behind-the-knee pins to limit backward movement of the passengers' legs once they are seated on the straddle-type seat. In many cases, though, these fixed pins provide another obstacle that has to be avoided or maneuvered around during loading and unloading, which can slow this process and also make it more awkward for the passengers.

Similarly, these ride vehicles may include deep footwells on both sides of the straddle-type seat to protect the passengers' legs and feet and to capture the passengers' footwear should it fall off during the ride. While being effective for these functions, deep footwells can make the ride vehicles more difficult to load and unload as the passengers have to step down into the footwell and swing the leg up and over the seat prior to positioning their lap bar restraint. This can increase the load and unload time and also can result in some accidents as passengers lose their balance. Hence, it would be desirable to provide an amusement park ride vehicle with a passenger restraint system that facilitates an open or minimally shrouded ride vehicle while also facilitating fast loading and unloading of passengers to facilitate higher ride throughputs.

There are a number of ride vehicles that have been designed with a more open design (e.g., with less shrouding) and have been used to provide motorcycle or bike-type ride experiences. Some of these ride vehicles have utilized a passenger restraint that is pivotally mounted at the rear portion of the ride vehicle. Once a passenger is positioned on the straddle-type seat, the restraint can be lowered into a locked position. In some cases, though, these restraints have only been provided in vehicles in which the passenger is placed in a prone position instead of an upright position. Hence, many rear-mounted restraint designs are not applicable to ride vehicles in which the passengers sit upright.

Further, these rear-mounted restraint systems have typically been used in rides where the length of each vehicle or each vehicle's longitudinal envelope can be relatively large. This is because the train of such vehicles has to be designed to allow a large space between adjacent vehicles so that the restraint can be rotated up and away from a passenger at the end of the ride for unloading (and then loading of the next passenger). As a result, these rear-mounted restraints often are not useful or desirable for amusement park rides in which the designer is required to meet a tight or small longitudinal envelope, e.g., where a ride designer is required to keep the passenger space of each vehicle short to allow more passengers to fit on a train of ride vehicles.

Hence, there remains a need for a passenger restraint system that is suited for maintaining passenger safety including providing proper leg constraint for passengers that are seated in an upright position on a straddle-type seat. Further, such passenger restraint systems preferably would be suited for rides with shorter trains or with relatively tight or small longitudinal envelopes provided for passenger seating and with little space between adjacent vehicles in the train. Still further, it is desirable for the passenger restraint to facilitate fast loading and unloading of passengers while also meeting other functional goals such as providing capture of footwear.

SUMMARY

The present description addresses the above and other problems by providing a passenger restraint system that is adapted for use with amusement park ride vehicles having upright, straddle-type seating of passengers. For example, the ride vehicle may be designed to provide a motorcycle-type ride experience with the rider sitting upright (and not in a prone position). With the restraint system, the ride vehicle can be open and only minimally shrouded, and passengers will be able to load and unload quickly and safely.

To this end, some embodiments of the restraint system include relatively shallow footwells, a behind-the-knee pin that slides rearward for loading and then forward into an engaged position, and a lap bar assembly located in the vehicle body forward of the straddle-type seat. The footwells are shallow to make loading and unloading less awkward than vehicles having very deep footwells on either sides of the passenger seat, but the depth of the footwells (such 2 to 6 inches or the like) is large enough to effectively capture loose footwear and other personal items. The behind-the-knee pin acts to limit movement of the passenger's legs rearward within the footwells or parallel to the longitudinal axis of the vehicle body (opposite the direction of travel of the vehicle). The behind-the-knee pin may be positionable via mechanical linkage or other mechanisms connected to the lap bar so as to be actuated with the lap bar assembly (e.g., slid forward into an engaged position when the passenger pulls on the lap bar to place the lap bar in an engaged position near their lap).

The lap bar assembly may be considered an integral unit formed of a U-shaped lap bar that is pivotally supported on the vehicle body such as via a rotation axle or shaft. A pair of front leg shields and a pair of side leg shields may be included in the lap bar assembly and be used to connect the U-shaped lap bar to the rotation axle. In this manner, both pairs of the leg shields pivot with the lap bar from a disengaged or up position that rotates the shields and lap bar forward and away from the passenger seat about the axis of the rotation axle or shaft to provide a passenger a clear and unobstructed path to the straddle-type passenger seat. Once the passenger is seated with their legs straddling a center portion or column of the vehicle body and their feet in the footwells, the lap bar and interconnected front and side leg shields can be rotated toward the seat and the seated passenger to the engaged or down position where it can be locked in place with a locking mechanism. The front leg shields limit (or even block) forward movement of the passenger's legs beyond a predefined location in the footwells (or along a longitudinal axis of the vehicle body) while the side leg shields limit (or even block) sideward or lateral movement of the passenger's legs beyond a predefined distance from the center portion or column of the vehicle body.

More particularly, a vehicle is provided that is adapted for use in an amusement park ride with upright, straddle-type passenger seating. The vehicle includes a vehicle body with a base and a center pedestal portion extending upward from an upper surface of the base. The vehicle also includes a seat assembly including a seat pan mounted on the center pedestal portion between a front end and a rear end of the vehicle body. In practice or use of the vehicle, a passenger seated on the seat pan straddles the center pedestal portion with a left leg on a left side of the center pedestal portion and a right leg on a right side of the center pedestal portion.

The vehicle includes a passenger restraint system that includes a lap bar assembly and lap bar pivotal mount element pivotally supporting the lap bar assembly within the vehicle body to pivot about a rotation axis passing through the vehicle body between the seat pan and the front end of the vehicle body. Further, the lap bar assembly may include a lap bar, a left side leg shield coupled to the lap bar pivotal mount element at a first end and to the lap bar at a second end, and a right side leg shield coupled to the lap bar pivotal mount element at a first end and to the lap bar at a second end. In some implementations, the lap bar assembly is rotatable about the rotation axis from a disengaged position to an engaged position, and a gap (e.g., of less than 3 inches such as about 1 inch) is provided between a lower edge of each of the side leg shields and the upper surface of the base with the lap bar assembly in the engaged position, whereby the left and right legs of the passenger seated on the seat pan are laterally contained within the vehicle (i.e., the passenger cannot swing their legs outward away from the center pedestal portion).

In practice, each of the side leg shields may have a body extending generally parallel to a longitudinal axis of the center pedestal portion. In these cases, each of the bodies of the side leg shields can be spaced apart from the center pedestal portion by a distance (e.g., at least 6 inches), whereby at least a portion of the left and right legs of the passenger seated on the seat pan are positionable between the center pedestal portion and the side leg shields with the lap bar assembly in the engaged position.

In some embodiments of the vehicle, the lap bar assembly further includes a left front leg shield extending outward from the first end of the left side leg shield toward the center pedestal portion. Further, the lap bar assembly may include a right front leg shield extending outward from the first end of the right side leg shield toward the center pedestal portion. In these embodiments, a gap is provided between each of the front leg shields and the upper surface of the base of the vehicle that is less than 3 inches (e.g., about 1 inch gaps). Further, the vehicle body may include left and right footwells adjacent the center pedestal portion, and the left front leg shield may extend across a substantial portion of the left footwell while the right front leg shield may extend across a substantial portion of the right footwell.

In the same or other implementations of the vehicle, the lap bar pivotal mount element may take the form of an axle pivotally supported by the center pedestal portion. In these or other cases, the passenger restraint system may further include a pair of behind-the-knee pins extending outward a distance from opposite sides of the center pedestal portion at locations below and aft of a front edge of the seat pan. In such cases, each of the behind-the-knee pins can be actuated to slide from a first position when the lap bar assembly is in a disengaged position to a second position that is forward of the first position when the lap bar assembly is in an engaged position. In particular vehicles, the behind-the-knee pins can then be mechanically linked to the lap bar assembly to move between the first and second positions with pivotal movement of the lap bar assembly about the lap bar pivotal mount element.

DETAILED DESCRIPTION

A lap bar restraint system is provided for achieving positive passenger containment for upright, straddle-type seating within a vehicle body that is open or minimally shrouded. The lap bar restraint system is adapted to support fast loading and unloading of the vehicle while also allowing a vehicle to be short in length (e.g., with a small longitudinal envelope especially when compared with vehicles having a restraint that rotates backward from the passenger and passenger seat or that uses prone positioning of the passenger).

The lap bar restraint system uses and leverages upon a U-shaped or U-type lap bar with interconnected (or integral) leg shielding and containment for front and side leg containment. Further, the lap bar restraint system includes, in some cases, articulating (or sliding) behind-the-knee bars, pegs, or pins to limit or constrain movement of the passenger's legs rearward within footwells on either side of the straddle-type passenger seat. The behind-the-knee pins may be operated independently from the lap bar (e.g., actuated mechanically or electrically operated to move the pin from a disengaged or aft position to an engaged or forward position). In other cases, the lap bar and behind-the-knee pin are mechanically linked together such that the pin is passenger-actuated by moving the lap bar in and out of an engaged or locked position (e.g., pulling down and/or rearward on the lap bar to move it into an engaged position near their lap acts to concurrently slide the pins forward toward or against the backs of their legs).

Figure 1:
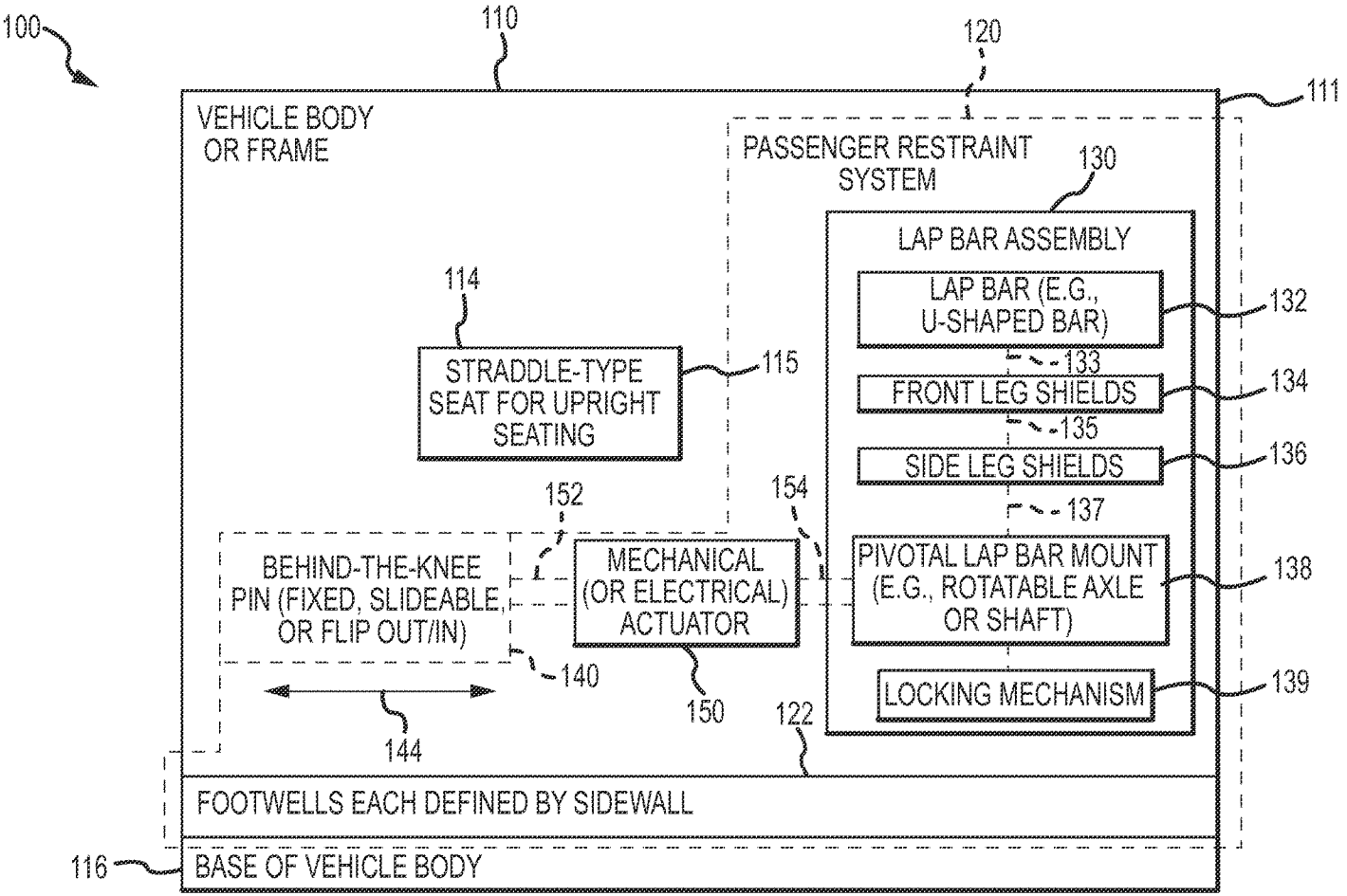
FIG. 1 is a functional block diagram of a ride vehicle for use in an amusement park ride (e.g., a train type ride with interconnected or linked sets of such vehicles) with a passenger restraint system of the present description.

FIG. 1 illustrates a functional block diagram of a ride vehicle 100 for use in an amusement park ride such as a train-type ride in which a number of such vehicles would be linked together and travel along a ride path or on a ride track (e.g., roller coaster or similar ride). The ride vehicle 100 includes a vehicle body or frame 110 upon which a straddle-type seat 114 is mounted, and the body 110 and seat 114 are configured to provide passengers with upright seating (e.g., not typically for use with passengers in a prone position). The front of the vehicle 110 is shown at 111 with a passenger using the seat 114 facing toward the front 111 of the vehicle 110 and the front or leading edge 115 of the seat 114.

The ride vehicle 100 includes a passenger restraint system 120 mounted on the vehicle body or frame 110. The passenger restraint system 120 is designed to ensure passenger safety while also addressing goals of fast ingress/egress (loading and unloading), safe and easy ingress/egress, and footwear capture. To provide footwear capture, the system 120 includes right and left footwells 122 on opposite sides (right and left sides) of the straddle-type seat 114. The footwells 122 typically are defined by vertical (or upward extending) sidewalls attached to a base or platform 116 of the vehicle body 110 such as at outer, side edges of the base/platform 116. These sidewalls may be relatively short, such as with a height of 2 to 6 inches (e.g., 3 inches in some cases), to provide shallow footwells 122 to aid in easy and safe loading of the vehicle 100 while still acting to capture any loose footwear or other passenger items.

More significantly, the passenger restraint system 120 includes a lap bar assembly 130 that is configured to provide a tight or short longitudinal envelope (e.g., short passenger pitch). To this end, the lap bar assembly 130 is mounted toward the front 111 of the vehicle body 110 or forward of the seat 114 (and a passenger on the seat 114). The lap bar assembly 130 includes a lap bar 132 such as a U-shaped, rigid bar or pole that a passenger on the seat 114 pulls downward toward their lap to engage the lap bar 132 at the beginning of a ride with vehicle 100 and that releases upward and forward at the end of the ride. To this end, the lap bar assembly 130 includes a pivotal lap bar mount 138. For example, the mount 138 may take the form of an axle or shaft that is attached to the body or frame 110 to be rotatable about its central, longitudinal axis while other mounts may be utilized (e.g., bearing surfaces on the body 110 that support the ends of the bar 132 or portions of the shields 134, 136 and allow for rotation or pivoting of the lap bar 132). The lap bar assembly 130 also includes a locking mechanism 139 that acts to engage and lock the lap bar 132 (or the pivotal mount 138) in the engaged position during use of the vehicle 100 in a ride and to disengage and unlock the lap bar (or the pivotal mount 138) at the end of a ride (as is well-known in the ride industry and, therefore, not discussed in further detail herein).

The lap bar assembly 130 further includes front (or longitudinal) leg shields (i.e., right and left front leg shields) 134 that are designed to extend outward from the body 110 in a direction that is transverse or even orthogonal from the longitudinal axis of the body 110 (e.g., transverse to the direction of travel of the vehicle 110 when in use in an amusement park ride). In this way, the shields 134 act to contain a passenger positioned on the seat 114 from moving their legs forward beyond a predefined location (e.g., beyond the location of the front shields 134 relative to the vehicle body/frame 110). Additionally, the front leg shields 134 may be configured to limit or prevent the passenger from lifting or moving their legs upward away from the base 116 (e.g., out of the footwells 122) when the lap bar assembly 130 is in the engaged or down position.

The front leg shields 134 are positioned forward of the seat 114 and are often located between the lap bar 132 (when it is in the engaged or down position) and the pivotal lap bar mount 138. Further, in some cases, the lap bar assembly 130 may be thought of as an integral or unitary assembly with the lap bar 132 being rigidly (or otherwise) interconnected with the pivotal lap bar mount 138 via the front leg shields 134 (and/or side leg shields 136) as shown via dashed lines 133, 135, and 137. Stated differently, the front leg shields 134 may act both as a forward containment of a passenger's legs in the vehicle body 110 and also act to interconnect and rigidly support the lap bar 132 such that the lap bar 132 may be pivoted from a disengaged or "up" position to an engaged or "down" position by rotating the mount 138 to which the front leg shields are affixed (e.g., one end of each shield 134 may be connected to an end of the lap bar 132 while the other or second end of each shield 134 is attached to or coupled with the axle/shaft or other pivotal lap bar mount 138) such that movement of the lap bar 132 causes the axle/mount 138 to rotate upon the body/frame 110 and also concurrently causes the front leg shields 134 to be moved between a disengaged position and an engaged (or forwardly contained) position.

As shown, the lab bar assembly 130 further includes side (or right and left) leg shields 136 that are configured to protect and/or constrain legs of a passenger seated on the straddle-type seat 114. Particularly, the side leg shields 136 may be designed and configured such that when the lap bar 132 is pivoted on mount 138 into the engaged or down position the side leg shields 136 function to limit sideward or outward movement of a passenger's legs away from the seat 114 and body/frame 110. For example, the side leg shields 136 may be configured to prevent movement of the passenger's legs beyond a predefined distance from the body/frame 110 (or the portion of a center portion of the body that is forward and below the seat 114), e.g., provide space for the passenger's feet, calves, and/or thighs but only allow lateral movement (i.e., movement orthogonal to the longitudinal axis of the body 110) of a safe and preset magnitude (e.g., less than 18 inches, less than 12 inches, or some other predefined maximum amount of lateral or side leg movement). Each of the side leg shields 136 may be connected to or extend out from one of the front leg shields 134 as shown with dashed line 135. The side leg shields 136 may rotate with movement of the front leg shields 134. In other cases, the side leg shields 136 may interconnect the front leg shields 134 and the lap bar 132.

In some ride vehicles 100, it may be useful to further constrain a passenger's movement of their legs when on the seat 114 by limiting the amount of rearward movement of the passenger's legs (e.g., in a direction opposite the direction of travel of the vehicle 110 or away from the front 111 of the body 110 along a longitudinal axis of the body 110). To this end, the passenger restraint system 120 may include a behind-the knee pin or peg 140 positioned on the body 110 at a location rearward or aft of the lap bar assembly 130. The pin 140 is provided below the seat 114, with the height of the pin 140 relative to the base 116 of the footwell 122 and distance of the pin 140 from the seat 114 (in the engaged position) being selected to limit rearward movement of a leg (e.g., foot or calf) of a passenger on the seat 114. This constraint is provided in combination with the side leg shields 136 as the passenger's leg is constrained by sideward or lateral movements away from the body 110 by the side leg shield 136 and from rearward movements by the pin/peg 140.

The behind-the-knee pin 140 may extend outward from the body 110 a predefined distance (e.g., about the width of a footwell 122 or a greater distance), which may coincide with a location of the side leg shields or the pin 140 may extend out some distance beyond the side leg shield 136. The pin 140 may be fixed in place in an engaged position. In other cases, though, it may be desirable for the pin 140 to be positionable between a disengaged position and an engaged position as shown with arrow 144, with such embodiments being useful for facilitating passenger loading and unloading.

To this end, a mechanical or electrical actuator (or linkage) 150 can be provided to move 144 the pin 140 into the engaged position upon operation of the lap bar assembly 130 to move the lap bar 132 and shields 134, 136 into their engaged positions. For example, the actuator 150 may be a mechanical linkage as shown at 152, 154 that interconnects the pin 144 with the pivotal lap bar mount 138 such that when the mount 138 is rotated or operated to move the lap bar 132 into an engaged position the pin 140 is slid forward 144 from a disengaged position (aft position) to an engaged position (forward position more proximate to the lap bar assembly 130 and the front of the body 111). This forward sliding actuation may cause the pin 140 to slide 144 (in a groove or slot on the body 110 in some cases) several-to-many inches (e.g., slide 4 to 12 inches or more forward toward the front edge 111 of the body 110).

In other cases, the pins 140 may have a disengaged position in which the pin 140 is more proximate to the sides of the body 110 below the seat 114 and the engaged position is when the pin 140 is rotated or flipped outward as shown with arrow 144 to an orientation transverse to the longitudinal axis of the body 110 (e.g., to have the longitudinal axes of the right and left pins moved from being parallel or substantially parallel to the longitudinal axis of the body 100 to being transverse or even orthogonal to this longitudinal axis). This sliding forward (and then backward at the end of a ride) or flipping outward (and then back inward) may also be performed with an electronic (or other) actuator that is not interconnected with the lap bar assembly 130 but that can act concurrently or independently of the lap bar assembly 130 to provide the movement 144 to place the pin 140 in the engaged position (and then return it to the disengaged position).

FIGS. 2-6 illustrate one useful implementation of a ride vehicle 200 that makes use of the passenger restraint techniques described herein, and, particularly, includes components useful for implementing a passenger restraint system (such as system 120 of FIG. 1) in a vehicle adapted for upright, straddle-type passenger seating. While not shown, the ride vehicle 200 may be used in a variety of amusement park rides such as a train-type ride (e.g., a roller coaster or the like) with a plurality of the ride vehicles 200 linked together end-to-end as the passenger restraint provided in the vehicle 200 supports a relatively small passenger envelope and overall ride vehicle length and also supports easy, safe, and quick ingress and egress.

Figure 2:
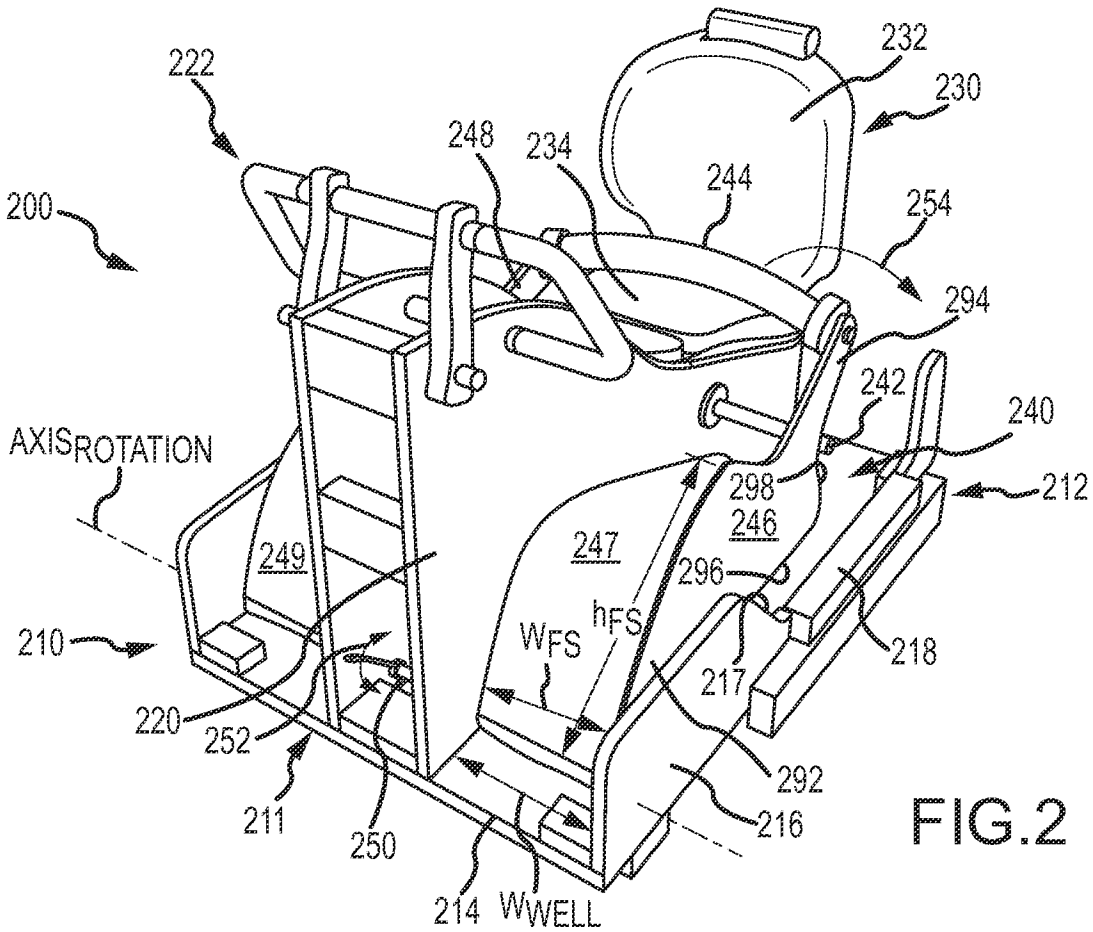
FIG. 2 is a front perspective view of a ride vehicle with a passenger restraint system of the present description, with the lap bar assembly shown in the engaged or down (or locked) position.

FIG. 2 is a front perspective view of the ride vehicle 200, with no passenger shown in the vehicle 200. The ride vehicle 200 includes a body or frame 210 having a front or front end 211 and a back or rear end 212. The body 210 includes a base or platform 214, which may be a rigid and planar plate or the like. The body 210 also includes, on each side, a sidewall 216 extending upward from an upper surface of the base 214, and the sidewall 216 includes a recessed segment 217 that extends a smaller distance from the base 214 to define an access or opening to the vehicle 200 for a passenger. A step plate 218 is provided in this access or opening in wall 216 to facilitate safe and less awkward ingress and egress by passengers.

The body 210 further includes a center portion or column 220 also extending upward from and supported upon the base 214. The center portion 220 of the body 210 is shown to be positioned or disposed between the left and right sidewalls 216, and it is used to support a handle bar or steering assembly 222, e.g., handles for a passenger to grip such as to simulate a motorcycle or similarly designed vehicle, at an upper and forward location (e.g., near the front 214 of the vehicle 210). The center portion 220 is also used to support a seat assembly 230 in the form of a back support 232 and a pan 234, and, as a result, the seating on seat assembly 230 is straddle-type seating as a passenger positions one leg on either side of the center portion 220 when in the seat pan 234. The seating is "upright" in that the passenger has their back supported by the seat back 232 in a vertical or near vertical arrangement rather than leaning forward in a prone position.

Footwells are defined on either side of the center portion 220 by a combination of the outer sidewalls of the center portion 220, the upper surface of the base 214, and inner surfaces of the sidewalls 216 with the step plates 218. The footwells extend along center portion 220 and sidewalls 216 and are configured for receiving a passenger's left and right legs and feet. To this end, the footwells have a width, $W_{Well}$, that is some amount greater than the largest anticipated passenger's legs and/or or feet, e.g., 6 to 12 inches or more in some implementations.

As shown in FIG. 2, the sidewalls 216 have a first height, $h_1$, for sections that are located forward and aft of the seat pan 234, and a second height, $h_2$, in the recessed section 217 where the step plate 218 is provided. The second height, $h_2$, may be chosen to be great enough to capture footwear or other items that may be lost by the passenger in the vehicle 200 or become loose and drop into one of the footwells. In some cases, the first height, $h_1$, is in the range of 6 to 18 inches while the second height, $h_2$, is 2 to 4 inches so as to define an access or opening in sidewalls 216 that facilitates easy access to the vehicle 200 and its seat pan 234 while still being useful for capturing footwear. This arrangement also avoids issues with deep footwells that can be awkward for passengers to navigate.

Significantly, the vehicle 200 is designed to provide forward (or longitudinal (i.e., forward along the longitudinal axis of the body 210), lateral (or sideward), and rearward containment of the legs of a passenger seated in the seat assembly 230. The seating is straddle-type seating as a passenger seated on the seat pan 234 would position their left and right legs on the left and right sides, respectively, of the center portion 220 of the vehicle body 210 with their left and right feet in the left and right footwells. The footwells with the sidewalls 216 would not provide adequate containment during ride operations without further restraints as the passenger could readily swing their legs over the step plate 218 and/or the top of the sidewalls 216 at other positions along its length.

To provide enhanced leg and/or foot containment, the ride vehicle 200 includes a lap bar assembly 240 and left and right behind-the-knee pins 242 (which together provide a passenger restraint system in the vehicle 200). The lap bar assembly 240 is adapted to restrain a passenger within the seat pan 234 and also to provide longitudinal and lateral leg constraint of both of the passenger's legs. To this end, the lap bar assembly 240 includes a lap bar 244 that is pivotally supported within the ride vehicle body 210 with a pivotal lap bar mount 250.

Figure 3:
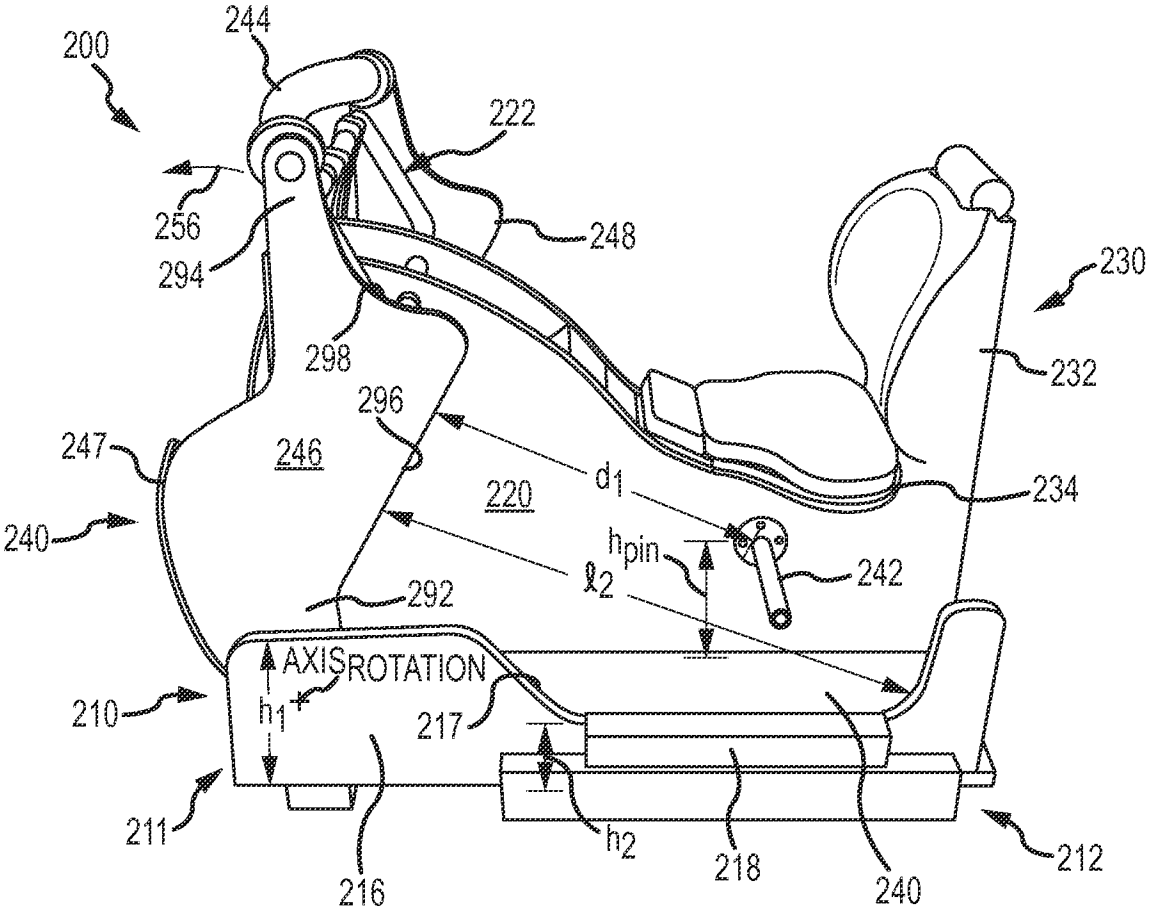
FIG. 3 is a side view of the ride vehicle of FIG. 2 with the lap bar assembly shown in the disengaged or up (or unlocked) position.

As shown, the pivotal lap bar mount 250 may be provided with an axle or shaft that extends all or a portion of the width of the body 210 and which may be pivotally supported (e.g., upon one or more bearings or bearing surfaces provided in the center portion 220 of the body 210). When a passenger pulls down as shown with arrow 254 (or pushes up) on the lap bar 244, the axle or mount 250 rotates about the rotation axis, $AXiS_{Rotation}$ (or linear axis of the axle 250) as shown with arrow 252. In this way, the lap bar 244 can be moved from a disengaged or up position (as shown in FIG. 3) to an engaged or down position (as shown in FIG. 2). A locking mechanism, not shown, would typically be included in the vehicle to lock the lap bar assembly in at least in the engaged position (e.g., during ride operations) and often also in the disengaged position to facilitate safer unloading of the vehicle 200.

In contrast, though, to conventional U-shaped lap bars, the lap bar assembly 240 further includes a left side leg shield 246, a left front leg shield 247, a right side leg shield 248, and a right front leg shield 249. The left side leg shield 246 is provided to contain a passenger's left leg within the left footwell by limiting movement of the passenger's left leg in a lateral direction outward from the center portion 220 of the body 210 while the right side leg shield 248 is provided to contain the passenger's right leg within the right footwell by limiting movement of the passenger's right leg in a lateral direction outward from the center portion 220 of the body 210.

To this end, as shown for left side leg shield 246, the shield 246 may be a planar (or curved) member with a length (e.g., 2 to 4 feet or the like) as measured between a first end 292 and a second end 294 that allows it to extend from the front end 211 of the vehicle body 210 to the seat pan 234 (or to a mid or further aft point of the seat pan 234) when the lap bar assembly 240 is positioned in the engaged or down position (as shown in FIG. 2). It is desirable for the shield 246 to rotate in and out of an engaged position with the lap bar 244, and, to achieve this goal, the shield 246 is affixed at its first end 292 to the rotation axle or shaft 250 and at its second end 294 to an end of the lap bar 244. In other words, the lap bar 244 and the shields 246, 248 can be provided as an integral or unitary member that rotates about the rotation axis, $Axis_{Rotation}$ (i.e., the bar 244 and all shields 246, 247, 248, and 249 rotate together in and out of the engaged position shown in FIG. 2 as shown with arrow 254 and rotation arrow 252 for axle/shaft 250).

In the disengaged position as shown in FIG. 3, the side leg shield 246 is moved forward of seat pan 234 and the access or opening in the sidewall 216 to allow a passenger to access the seat assembly 230. In this position, a lower edge 296 may be spaced apart a distance, $d_1$, from the behind-the-knee pin 242 and a distance, $d_2$, from a back edge of the recessed segment 217 (where the sidewall 216 returns to its greater height, $h_1$) with these distances being chosen to facilitate safe and non-awkward access such as with $d_1$ being in the range of 2 to 3 feet and $d_2$ being in the range of 3 to 5 feet. In the engaged or down position as shown in FIG. 2, the side leg shield 246 is swung down toward the base 214 and has end 294 adjacent to the seat pan 234 and pin 242 (but with a gap of at least 1 inch between the pin 242 and the rear edge 298 of the shield 246 to avoid creation of a pinch point). The side leg shield 246 is spaced apart a distance from the nearby outer surface of the center portion so as to provide a space for receiving a passenger's leg, such as a distance that is less than the width of the well, $W_{Well}$, by 1 inch or more to avoid a pinch point between the shield 246 and wall 216 (or a distance in the range of 10 to 16 inches or the like).

In addition to lateral or sideward containment, it may be desirable in many vehicles 200 to also limit the amount of forward or longitudinal (in the forward direction) movement of a passenger's legs. To this end, the lap bar assembly 240 also includes a left front leg shield 247 and a right front leg shield 249. The left front leg shield 247 is provided to contain a passenger's left leg within the left footwell by limiting movement of the passenger's left leg in a forward or longitudinal direction (e.g., along the length of the body's center portion 220 away from the seat pan 234 toward the front edge 211 of the vehicle body 210) while the right forward leg shield 249 is provided to contain the passenger's right leg within the right footwell by limiting movement of the passenger's right leg in a forward or longitudinal direction (e.g., along the length of the center portion 220 away from the seat pan 234 toward the front edge 211). For example, it may be desirable to block travel of the passenger's feet and legs beyond a point some distance from the front edge 211 of the body 210 (or some distance forward from the seat pan 234).

To achieve this goal, as shown with left front leg shield 247, the front leg shield 247 is affixed to the side leg shield 246 (e.g., to an edge opposite the lower edge 296), and the leg shield 247 is positionable from an engaged position shown in FIG. 2 to a disengaged position shown in FIG. 3 with movement of the side leg shield 246 (and lap bar 244) about the rotation axis, $Axis_{Rotation}$. The front leg shield 247 extends transverse to a plane extending through the side leg shield 246 so as to act as a containment member for the right footwell. In other words, the front leg shield 247 blocks travel of items such as a passenger's foot and/or leg beyond its location in the footwell. The shield 247 has a width, $W_{FS}$, that nearly matches (at least at its sections near the base 214) the width, $W_{well}$, of the footwell so that a passenger cannot move their foot and/or leg outside the footwell in the forward or longitudinal direction. In some cases, the width, $W_{FS}$, is two inches or more less than the width, $W_{Well}$, to provide adequate clearance (e.g., 1 inch or more) on its inner and outer edges to avoid pinch points and provide clearance for its movement within the footwell of the vehicle 200. Further, to provide forward leg containment, the shield 247 has a height, $h_{FS}$, (e.g., 12 to 36 inches or the like) that makes it difficult for a passenger to lift their leg out of the footwell with the shield 247 in the engaged or down position (e.g., the shield 247 typically will extend some distance over the passenger's foot and leg such as over their knee and a portion of their thigh blocking upward movement as well as blocking movement of their foot past the forward edge of the shield 247 such as beyond the axle/shaft 250 in the vehicle 200).

To further contain the passenger's legs in the vehicle 200, pins or pegs are provided in the footwells or adjacent the center portion 220 to limit rearward movement or movement toward the rear or aft edge 212 of the vehicle 200. As shown in FIGS. 2-6, a behind-the-knee pin 242 is included (one would be provided on both sides of the center portion 220 of the body 210) that extends transverse to the outer surface of the center portion 220 into the footwell (or a distance such as 6 to 12 inches outward toward the sidewalls 216). As shown more clearly in FIG. 3, the pin 242 is typically positioned below the seat pan 234 at a height, hPin, above the base 214 (e.g., 4 to 10 inches above the base 214) so as to block rearward movement (e.g., movement along the longitudinal axis of the vehicle 210 in a direction toward the rear or aft edge 212 of the body 210) of a passenger's legs and/or feet so as to retain the leg within the containment provided by the shields 246 and 247 (and footwell of the vehicle 200). The pin 242 may be positioned at a center point of the seat pan 234 or in another position relative to the pan 234 such as further aft toward the back edge 212 of the body 210.

The behind-the-knee pin 242 may be a fixed and rigid element as shown in FIGS. 2-6. In other cases, though, the behind-the-knee pin 242 may be adapted to rotate from a disengaged position where it is flush (or nearly flush) with an outer surface of the center portion 220 of the body 210 to an engaged position (e.g., the position shown in FIG. 2-6). This rotation may be actuated by a mechanical linkage with the lap bar assembly 240 (e.g., with the shaft 250) such that its rotation (or flipping inward and outward) occurs automatically with movement of the lap bar 244. In other cases, the actuation may be automated and triggered by movement of the lap bar 244 (or another trigger) such as with electric motors or the like. Instead of flipping outward (and inward), the pin 242 may slide within a groove from a disengaged position further aft (to facilitate easy and less awkward egress) to an engaged position (as shown in FIG. 3 for example). Such an embodiment is shown in the vehicle 700 shown in FIGS. 7-10 and described in more detail below.

Figure 4:
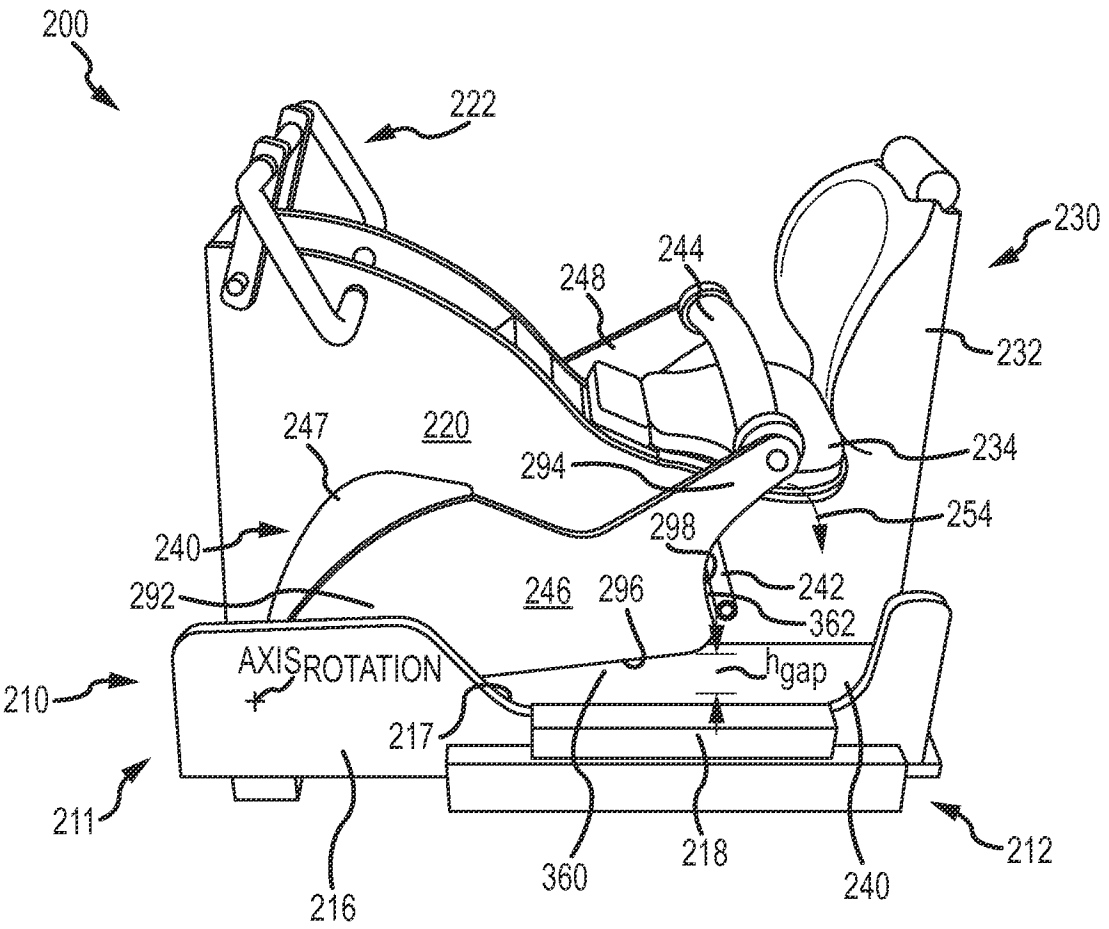
FIG. 4 is a side view of the ride vehicle of FIGS. 2 and 3 with the lap bar assembly shown in the engaged or down (or locked) position.
Figure 6:
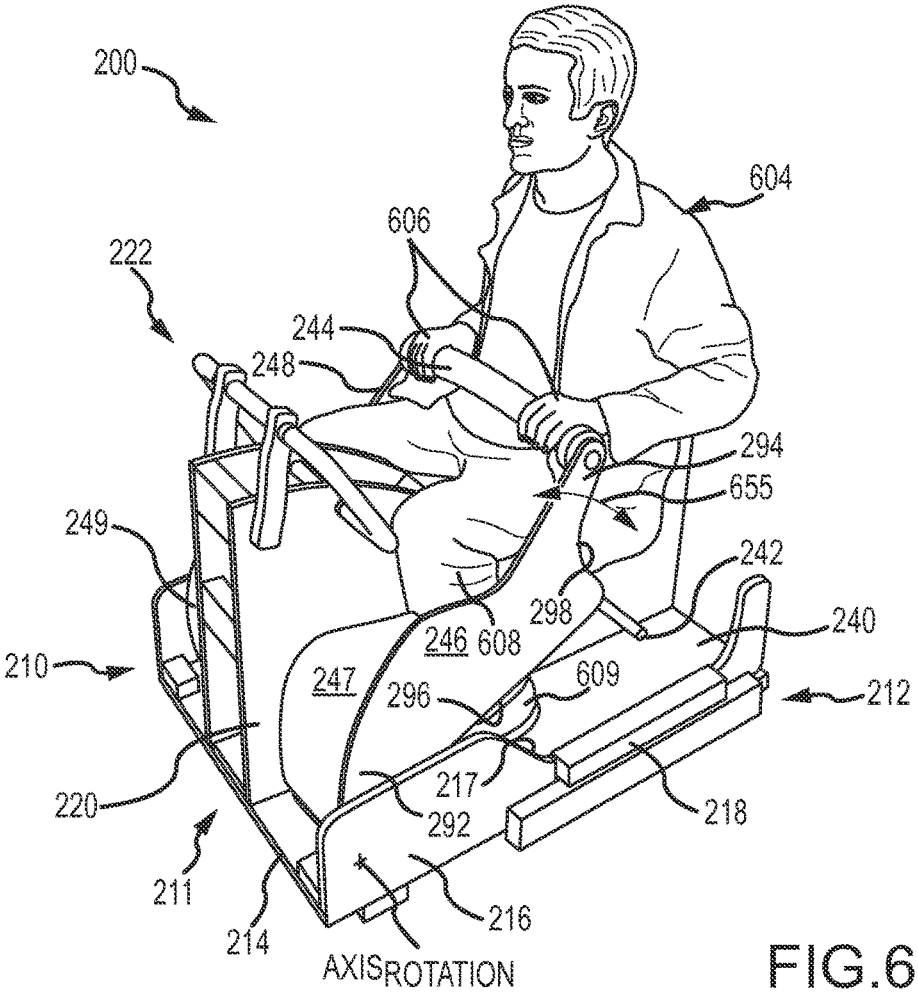
FIG. 6 is a perspective view of the ride vehicle of FIGS. 2-5 similar to that of FIG. 2 but with a ride passenger seated in the vehicle seat and with his movement constrained by the engaged passenger restraint system including the lowered lap bar assembly with its front and side leg shields.

FIG. 4 shows a side view of the vehicle 200 with the lap bar assembly 240 in the engaged or down position. In this position, the lap bar 244 is rotated 254 toward the seat pan 234 and a passenger's lap when a passenger is seated in the seat assembly as shown in FIG. 6. In this down or engaged position, a gap or space 360 is provided between the lower edge or side 296 of the side leg shield 246 and an upper surface of the base or platform 214 in the left footwell of the vehicle 200. The size of this gap 360 may be stated as a gap height, $h_{Gap}$, that may be chosen to be at least 1 inch (to avoid a pinch point) but small enough to fully contain a passenger's feet and/or legs in the footwell such as less than about 4 inches. As shown, the lower edge 296 may be generally parallel to the base 214 in the engaged or down position of the lap bar assembly 240. Also, in the engaged position, there is a gap 362 provided between the behind-the-knee pin or peg 242 and a rear edge or side 298 of the side leg shield 246, and this gap 362 typically would have a magnitude of 1 to 4 inches (or more in some cases) to avoid a pinch point but to also constrain movement of a foot or leg of a passenger out of the footwell and contained spaced defined by the shields 246 and 247 and pin 242.

Figure 5:
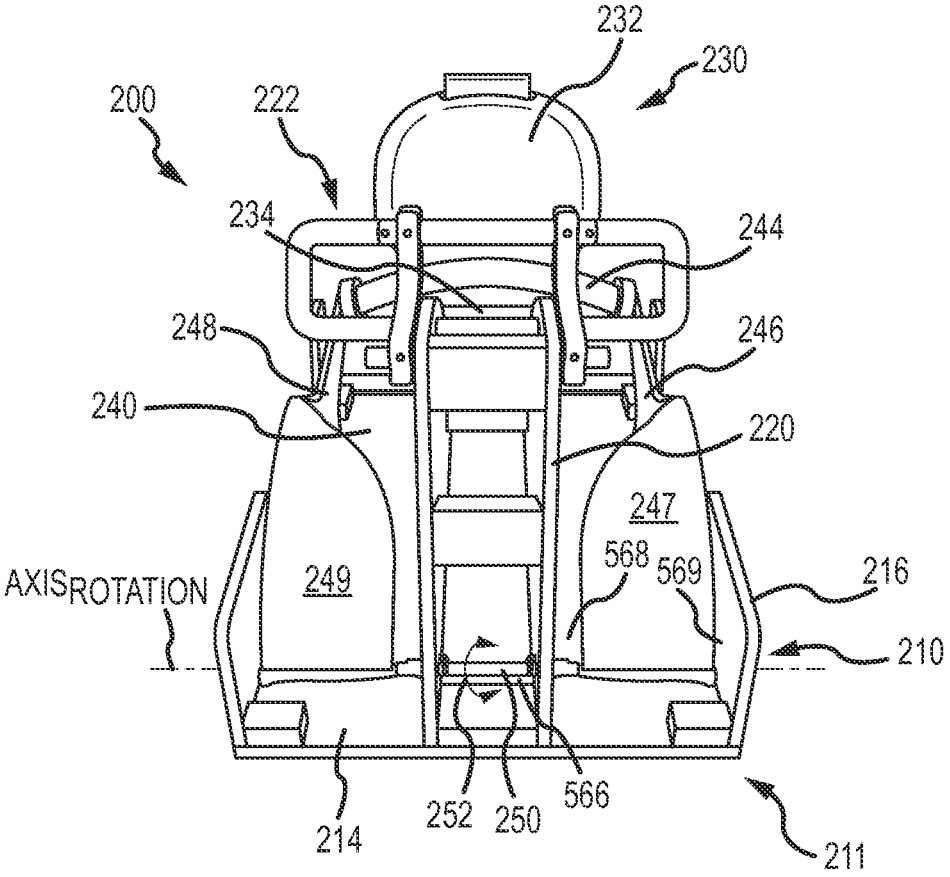
FIG. 5 is a front view of the ride vehicle of FIGS. 2-4 with the lap bar assembly shown in the engaged or down (or locked) position.

FIG. 5 illustrates a front view of the vehicle 200 with the lap bar assembly 240 in the down or engaged position. As shown, the rotation axle or shaft 250 may be supported (e.g., upon bearings or bearing surfaces and interconnected with a locking mechanism) upon the center portion 220 such that there is a gap or spacing 566 between the axle 250 and the upper surface of the base 214 of the vehicle body 210. This gap 566 may be relatively small (e.g., 1 to 3 inches or the like) to avoid providing a space for a passenger's foot to slide underneath the axle 250 and lower front or leading edge of the front leg shields 247, 249. Gaps or spaces 568, 569 are also provided between the side edges of the shields 247, 249 and the adjacent surfaces of the center portion 220 and sidewall 216 as shown for shield 247. These gaps 568, 569 are also chosen to be large enough to avoid creating a pinch point such as at least 1 inch but small enough to provide forward or longitudinal containment such as less than 3 inches or the like.

FIG. 6 illustrates a side upper perspective view of the vehicle 200 with a passenger 604 positioned in the seat assembly 230 and with the lap bar assembly 240 in the down or engaged position. In the illustrated embodiment, the passenger 604 engages the lap bar assembly 240 by grasping the lap bar 244 with their hands 606 and pulling the lap bar 244 downward from the disengaged or up position (shown in FIG. 3) into the engaged position as shown with arrow 655. This causes the axle 250 (and interconnected shields 246, 247, 248, 249) to rotate about the rotation axis, $Axis_{Rotation}$.

As shown in FIG. 6, the passenger 604 has his left leg 608 restrained longitudinally by the front leg shield 247 (in the forward direction) and by the behind-the-knee pin 242 (in the rearward or aft direction) and also restrained laterally by the side leg shield 246. In this manner, the passenger 604 can ride in the vehicle 200 safely when the vehicle 200 is used in an amusement park ride without concern of the passenger 604 being able to move their leg 608 or foot 609 into an unsafe position.

FIGS. 7-10 illustrate another embodiment of a ride vehicle 700 for use in an amusement park ride and with the passenger restraint features described herein. The ride vehicle 700 is a tandem vehicle designed for seating two passengers, and the following description discusses passenger restraint with reference to the rear passenger envelope with the understanding that similar restraint would be provided in the forward passenger envelope or space.

Figure 7:
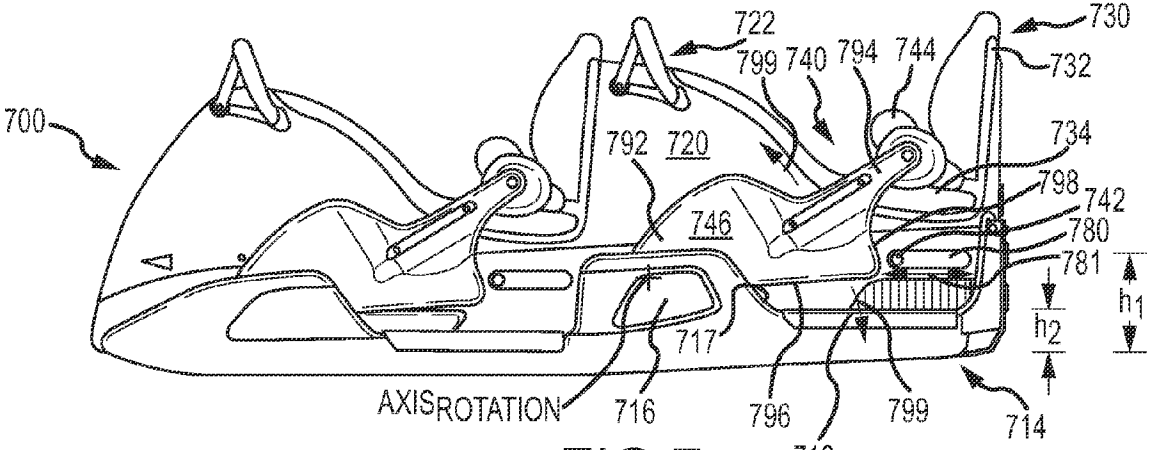
FIG. 7 illustrates a side view of a tandem ride vehicle with an embodiment of a passenger restraint system as described herein and including a lap bar assembly shown to be in the engaged or down (or locked) position.
Figure 8:
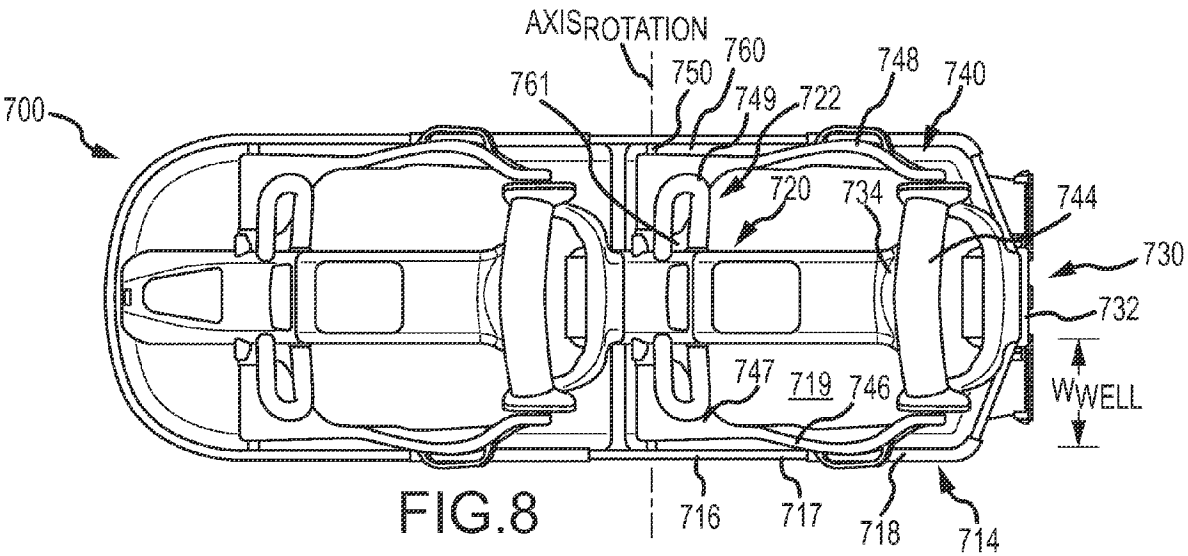
FIG. 8 is a plan (or top) view of the ride vehicle of FIG. 7 showing a rotation axle or shaft used to pivotally mount the integral front leg shields, side leg shields, and lap bar to the vehicle body and also showing relative positions of the lap bar assembly components to the vehicle body components (e.g., defining a foot well with leg containments in the forward or longitudinal directions and the lateral or side directions)

With reference to FIGS. 7 and 8, the vehicle 700 includes a base or platform 714 as part of its vehicle body with a center portion or pedestal 720 extending upward from an upper surface 719 of the base 714 along a center area of the vehicle 700. A seat assembly 730 is mounted upon an upper rear segment of the center body portion 720 including a seat back 732 and a seat pan 734. The center body portion 720 along with seat pan 734 and seat back 732 define an upright straddle-type seating arrangement for passengers of the vehicle 700 as the passengers step over the center portion 720 and/or seat pan 734 to position one leg on each side of the center portion 720 as they position themselves in the seat assembly 730. The vehicle 700 further includes a handle bar assembly 722 provided on an upper forward segment of the center body portion 720, and the assembly 722 may be rigidly or otherwise mounted in the vehicle 700 and be adapted to simulate a particular ride experience (e.g., a motorcycle or bike or other experience suited for upright, straddle-type seating of passengers).

A vertical (or generally vertical) sidewall 716 is provided that defines a footwell with a width, $W_{Well}$ (e.g., 8 to 14 inches) between the outer surfaces of the center body portion 720 and the inner surfaces of the sidewall 716. The footwell and sidewall 716 are shown to run the length of the center body portion 720 (e.g., along the length of the rear passenger envelope or space of the vehicle 700). A recessed section or segment 717 of the sidewall 716 defines an access or opening to the vehicle 700 and the seat assembly 730 for a passenger with a step plate 718 being provided on an upper surface of the recessed section 717. The sidewall 716 may have a first height, $h_1$, that is relatively high to enclose the footwell such as 6 to 12 inches while the sidewall height, $h_2$, at the recessed section 717 and step plate 718 may be much less to allow easy ingress/egress (avoid a trip hazard) but still retain loose shoes or other passenger articles. In some cases, the second height, $h_2$, is in the range of 2 to 6 inches with 3 inches used in some implementations. The length of the opening and step plate 718 may be large enough to make ingress/egress safe and non-awkward such as at least the length of the seat pan 734 or in the range of 18 to 36 inches.

The vehicle 700 further includes a passenger restraint system 740 that includes a behind-the-knee pin 742 along with a lap bar assembly including a lap bar 744 and interconnected side leg shields 746, 748 and front leg shields 747, 749. As shown with arrows 799, the shields 746, 747, 748, and 749 and the lap bar 744 are pivotal as a unit between a disengaged or up position (not shown but would be similar to that shown in FIG. 3 for lap bar assembly 240) and an engaged or down position. To this end, the passenger restraint system 740 further includes a pivotal member 750 such as a shaft or axle supported by the center body portion 720 and defining a rotation axis, $Axis_{Rotation}$, for the lap bar assembly (integral leg shields and lap bar).

In the down or engaged position, as shown with left side leg shield 746, a lower edge 796 is positioned proximate to the upper surface 719 of the base 714. Further, a rear or aft edge 798 is positioned proximate to the behind-the-knee pin 742, with the shield 746 extending between a front or first end 792 to a back or second end 794. In this manner, the side shield 746 acts to constrain movement of a passenger's leg (left leg in this case) to the width, $W_{well}$, of the footwell and within the sidewall 716. The behind-the-knee pin 742 is shown in the engaged position or forward position in the groove 780 (underneath the seat pan 734 at a forward or center position in the pan 734), and, with the pin 742 spaced apart a small gap distance (e.g., 1 to 2 inches or the like), a passenger is blocked from moving their leg longitudinally rearward toward the back of the vehicle 700.

Figure 9B:
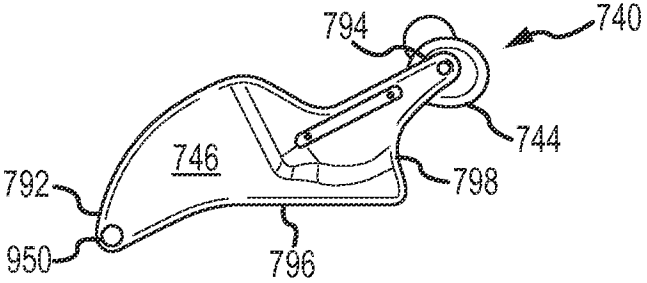
FIGS. 9A-9C are top/plan, side, and front views of the lap bar assembly of FIGS. 7 and 8 showing the integration of the front and side leg shields with the lap bar into an integral unit or member (e.g., to provide a unitary member that can be pivoted upon its rotational mount to the vehicle body between a fully disengaged position and an engaged or locked position)
Figure 9C:
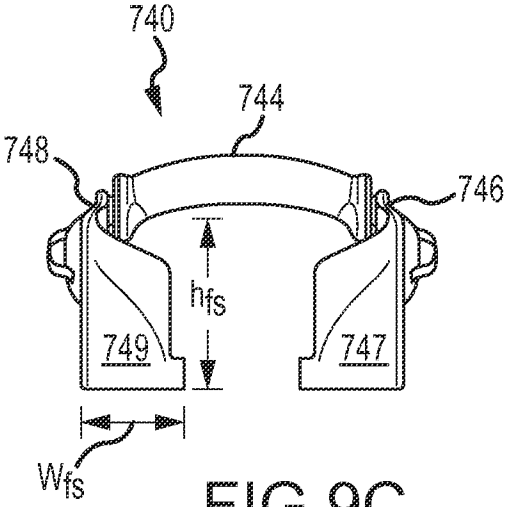
Figure 9A:
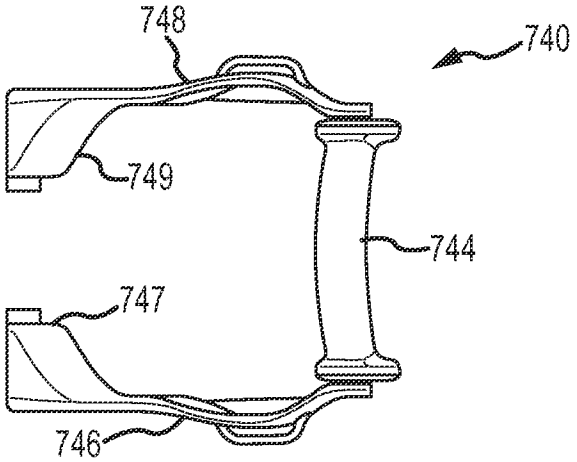

FIGS. 9A-9C illustrate, at least partially, a top or plan view, a side or elevation view, and a front end view, respectively, of the passenger restraint system 740. Specifically, these figures show that the system 740 includes a unitary or integral unit made up of a lap bar 744 attached at a first end to the left side leg shield 746 and at a second end to the right side leg shield 748. These three components define a U-shaped unit, with the lap bar 744 extending transverse or even orthogonal to shields 746, 748. At ends of the side leg shields 746, 748 opposite the lap bar 744, the system 740 includes left and right front leg shields 747, 749.

These shields 747, 749 extend transversely (or even orthogonally) out from the side leg shields 746, 748, respectively, and each may have a width, $W_{FS}$, that is some distance less than the width, $W_{Well}$, of a corresponding footwell (e.g., to leave a 1 inch or greater gap on the outer edges of the shields 747, 749 to the adjacent center portion 720 and sidewall 716). Each shield 747, 749 also has a length or height, $h_{FS}$, that is selected to provide a desired containment of a passenger's leg in the forward longitudinal direction such as in the range of 12 to 24 inches. At the end 792, a tubular-shaped passageway 950 is provided for receiving the axle 750 (or pivotal lap bar mount element), which may be press fit or otherwise rigidly attached to the lap bar assembly 740 (via the side leg shields 746, 748 as shown or the front leg shields 747, 749).

Figure 10:
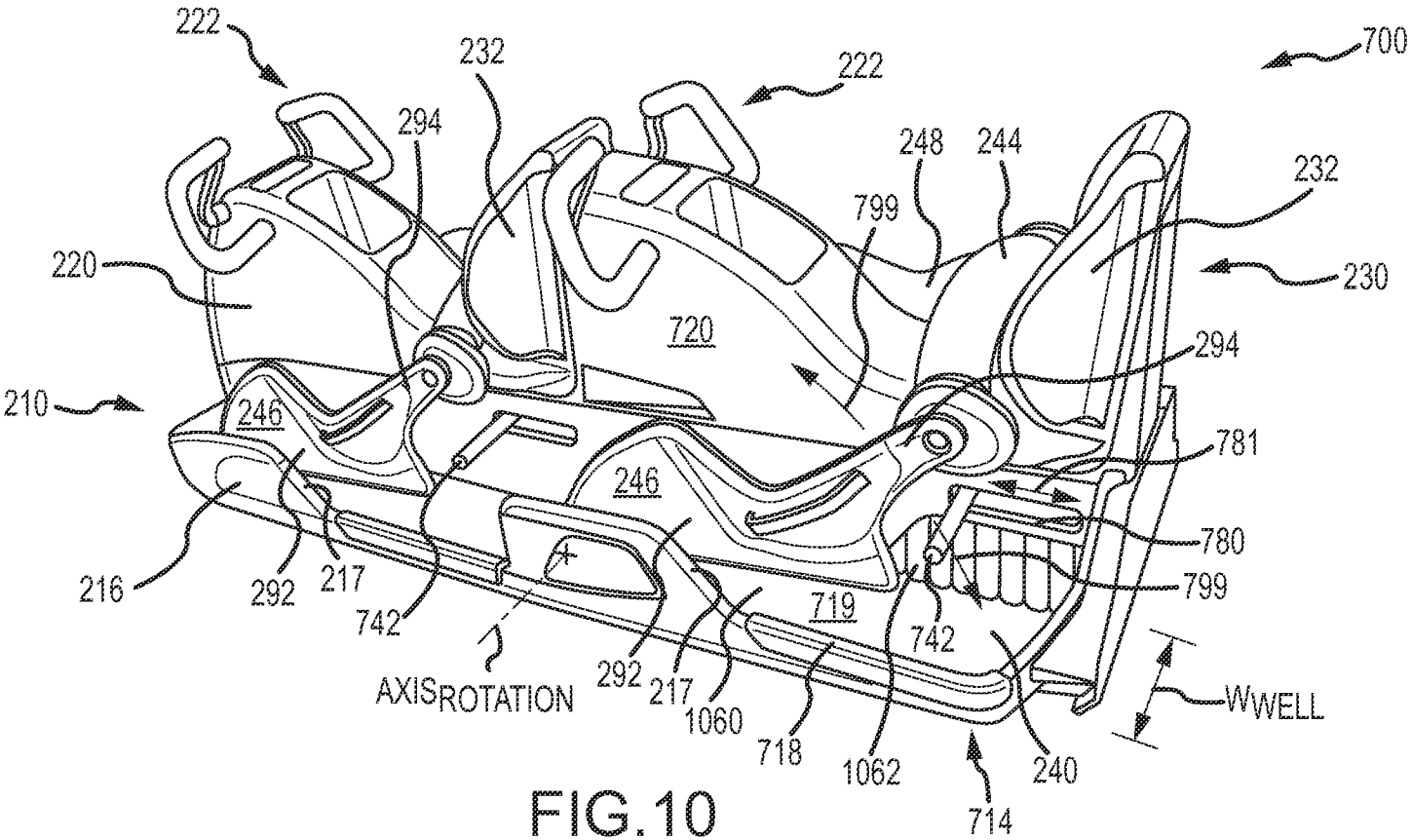
FIG. 10 illustrates a rear perspective view of the ride vehicle of FIGS. 7 and 8 showing the behind-the-knee pin or peg in more detail and its movement within a guide slot or groove on the vehicle body between an engaged position (shown in FIG. 10) and a disengaged position further aft or rear than the engaged position.

FIG. 10 illustrates a rear perspective view of the vehicle 700 showing again the passenger restraint system 740 being rotatable as shown with arrows 799 about the rotation axis, $Axis_{Rotation}$. Stated differently, the shields 746, 747, 748, and 749 along with the lap bar 744 are pivotally mounted to the vehicle body (e.g., center portion 720 or sidewalls 716) via an axle or shaft 750 (or other components if attached only to the sidewalls 716). The rotation axis, $Axis_{Rotation}$, may be positioned so as to be forward of the seat pan 734 and, in some cases, to extend through a lower portion of the vehicle body such as through the sidewall 716. FIG. 10 also shows more clearly that the behind-the-knee pin or peg 742 is configured to slide forward toward the front edge or end of the vehicle 700 from a disengaged first position further aft to an engaged or second position further (e.g., 6 to 12 inches) forward (such as to a position under a center location of the seat pan 734 or further forward). In this manner, the pin 742 is less of an obstruction to the seat assembly 730 during loading and unloading but acts to constrain rearward movement once slid forward toward the side leg shield 746 (and another pin would be provided on the opposite side near side leg shield 748).

A mechanical linkage (e.g., a mechanical actuator) may be used to interconnect the pin 742 with the lap bar assembly (e.g., with shaft/axle 750 or the like) such that when the lap bar 744 is rotated/pivoted was shown with arrows 799 the pin 742 slides in an opposite direction (forward when the lap bar 744 is pulled backward/downward and rearward when the lap bar is pushed up/forward to the disengaged position). In other cases, an electrical or other actuator may be used to independently operate the pin 742, i.e., provide the sliding 781 in the groove/slot 780. A trigger to actuation may be the operation of the lap bar assembly such as sliding 781 forward upon locking/engagement of the lap bar assembly and sliding 781 rearward upon unlocking/disengagement of the lap bar assembly.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

Prior restraints in amusement park ride vehicles were developed for passengers in a straddle-seating arrangement, but many of these designs placed the passenger in a prone position. These did not, therefore, use a lap bar and typically presented an excessively large longitudinal package or envelope when compared with the ride vehicles using the presently described lap bar restraint system. In other straddle-type seating restraints, articulating or rotating back restraints are used. These restraint designs generally provided poor lateral or side leg containment and required a lot of longitudinal space for each vehicle to provide room for rotating the back or rearward restraint (e.g., fewer vehicles could be provided in a train of a given length when compared with the present restraint system). Other vehicle designs with straddle-type seating use a T-shaped or style lap bar and deep footwells for leg containment, which can make ingress and egress slow and relatively unsafe or at least awkward for the passengers. The T-shaped lap bar systems also often have multiple pinch points, which may make their use less desirable especially when combined with a fixed behind-the-knee pin constraint that presents another obstruction during ingress and egress from the ride vehicle.

The lap bar restraint systems taught herein provide a number of significant advantages over prior restraint designs. The restraint systems provide positive passenger containment and restraint for an upright, straddle-type seating position that also allows for ease in ingress and egress by the passengers. The lap bar with integral shielding allows for enhanced or added leg containment when compared with traditional lap bar restraints. Hence, the lap bar restraint system is targeted for use with a more open type of vehicle with a straddle-type seat where positive passenger restraint and/or containment is achieved especially when the lap bar is coupled with behind-the-knee pins. The lap bar restraint system provides a very tight (or short) longitudinal package and passenger pitch that may be useful for solo, tandem, and other seating configurations when compared with other restraint systems, which should allow ride designers to achieve a decreased overall vehicle length.

A wide variety of materials may be used to fabricate the components of the passenger restraint system and lap bar assembly described herein such as plastics, metals, composites, and the like. The components may generally be rigid but flexible and/or resilient materials may be used in some cases or for particular components (e.g., padding may be provided on surfaces which may contact the passenger of a ride vehicle). The shields may be solid as shown in the figures or may contain relatively small openings (not large enough to pass a passenger's foot and so on) such as mesh or screen shield design. The shapes of the shields may also vary widely to implement the containment functions taught in this description with the figures providing exemplary and useful but not limiting shapes for the shields.

I claim:

1. A vehicle for use in an amusement park ride with upright, straddle-type passenger seating, comprising:

a vehicle body with a base and a center pedestal portion extending upward from an upper surface of the base;

a seat assembly including a seat pan mounted on the center pedestal portion between a front end and a rear end of the vehicle body, wherein a passenger seated on the seat pan straddles the center pedestal portion with a left leg on a left side of the center pedestal portion and a right leg on a right side of the center pedestal portion; and a passenger restraint system comprising a lap bar assembly and a lap bar pivotal mount element pivotally supporting the lap bar assembly within the vehicle body to pivot about a rotation axis passing through the vehicle body between the seat pan and the front end of the vehicle body, wherein the lap bar assembly comprises a lap bar, a left side leg shield coupled to the lap bar pivotal mount element at a first end and to the lap bar at a second end, and a right side leg shield coupled to the lap bar pivotal mount element at a first end and to the lap bar at a second end, and wherein the lap bar, the left side leg shield, and the right side leg shield rotate about the rotation axis as a unitary member.

2. The vehicle of claim 1, wherein the lap bar assembly is rotatable about the rotation axis from a disengaged position to an engaged position and wherein a gap of less than 3 inches is provided between a lower edge of each of the side leg shields and the upper surface of the base with the lap bar assembly in the engaged position, whereby the left and right legs of the passenger seated on the seat pan are laterally contained within the vehicle.

3. The vehicle of claim 2, wherein each of the side leg shields has a body extending generally parallel to a longitudinal axis of the center pedestal portion.

4. The vehicle of claim 3, wherein each of the bodies of the side leg shields is spaced apart from the center pedestal portion by a distance of at least 8 inches, whereby at least a portion of the left and right legs of the passenger seated on the seat pan are positionable between the center pedestal portion and the side leg shields with the lap bar assembly in the engaged position.

5. The vehicle of claim 2, wherein the lap bar assembly further comprises a left front leg shield extending outward from the first end of the left side leg shield toward the center pedestal portion and wherein the lap bar assembly further comprises a right front leg shield extending outward from the first end of the right side leg shield toward the center pedestal portion.

6. The vehicle of claim 5, wherein a gap is provided between each of the front leg shields and the upper surface of the base of the vehicle that is less than 3 inches, wherein the vehicle body further includes left and right footwells adjacent the center pedestal portion, and wherein the left front leg shield extends across a substantial portion of the left footwell and the right front leg shield extends across a substantial portion of the right footwell.

7. The vehicle of claim 1, wherein the lap bar pivotal mount element comprises an axle pivotally supported by the center pedestal portion.

8. The vehicle of claim 1, wherein the passenger restraint system further comprises a pair of behind-the-knee pins extending outward a distance from opposite sides of the center pedestal portion at locations below and aft of a front edge of the seat pan.

9. The vehicle of claim 8, wherein each of the behind-the-knee pins is actuated to slide from a first position when the lap bar assembly is in a disengaged position to a second position that is forward of the first position when the lap bar assembly is in an engaged position.

10. The vehicle of claim 9, wherein the behind-the-knee pins are mechanically linked to the lap bar assembly to move between the first and second positions with pivotal movement of the lap bar assembly about the lap bar pivotal mount element.

11. A vehicle for use in an amusement park ride with upright, straddle-type passenger seating, comprising:

a vehicle body;

a seat assembly including a seat pan mounted on the vehicle body between a front end and a rear end of the vehicle body; and a passenger restraint system comprising a lap bar assembly and a lap bar pivotal mount element pivotally supporting the lap bar assembly within the vehicle body to pivot about a rotation axis passing through the vehicle body, wherein the lap bar assembly comprises:

a lap bar, a left side leg shield attached to the lap bar pivotal mount element at a first end and to the lap bar at a second end, a right side leg shield rigidly attached to the lap bar pivotal mount element at a first end and to the lap bar at a second end, a left front leg shield extending outward from the first end of the left side leg shield toward the center pedestal portion, and a right front leg shield extending outward from the first end of the right side leg shield toward the center pedestal portion, wherein the lap bar assembly is pivotable as a unit about the rotation axis from a disengaged position to an engaged position.

12. The vehicle of claim 11, wherein a gap of less than 3 inches is provided between a lower edge of each of the side leg shields and the upper surface of the base with the lap bar assembly in the engaged position, whereby the left and right legs of the passenger seated on the seat pan are laterally contained within the vehicle.

13. The vehicle of claim 11, wherein each of the side leg shields has a body extending generally parallel to a longitudinal axis of the center pedestal portion.

14. The vehicle of claim 11, wherein each of the bodies of the side leg shields is spaced apart from the center pedestal portion by a distance of at least 8 inches, whereby at least a portion of the left and right legs of the passenger seated on the seat pan are positionable between the center pedestal portion and the side leg shields with the lap bar assembly in the engaged position.

15. The vehicle of claim 11, wherein a gap is provided between each of the front leg shields and the upper surface of the base of the vehicle that is less than 3 inches, wherein the vehicle body further includes left and right footwells adjacent the center pedestal portion, and wherein the left front leg shield extends across a substantial portion of the left footwell and the right front leg shield extends across a substantial portion of the right footwell.

16. The vehicle of claim 11, wherein the passenger restraint system further comprises a pair of behind-the-knee pins extending outward a distance from opposite sides of the center pedestal portion at locations below and aft of a front edge of the seat pan and further wherein each of the behind-the-knee pins is actuated to slide from a first position when the lap bar assembly is in the disengaged position to a second position that is forward of the first position when the lap bar assembly is in the engaged position.

17. A vehicle with upright, straddle-type passenger seating, comprising:

a vehicle body with a center pedestal;

a seat assembly including a seat pan mounted on the center pedestal between a front end and a rear end of the vehicle body; and a passenger restraint system comprising a lap bar assembly and a lap bar pivotal mount element pivotally supporting the lap bar assembly within the vehicle body to pivot about a rotation axis passing through the vehicle body between the seat pan and the front end of the vehicle body, wherein the lap bar pivotal mount element comprises an axle pivotally supported by the center pedestal, wherein the lap bar assembly comprises a lap bar, a left side leg shield coupled to the lap bar pivotal mount element at a first end and to the lap bar at a second end, and a right side leg shield coupled to the lap bar pivotal mount element at a first end and to the lap bar at a second end, wherein the lap bar assembly further comprises a left front leg shield extending outward from the first end of the left side leg shield toward the center pedestal, and wherein the lap bar assembly further comprises a right front leg shield extending outward from the first end of the right side leg shield toward the center pedestal.

18. The vehicle of claim 17, wherein the lap bar assembly is rotatable about the rotation axis from a disengaged position to an engaged position and wherein a gap of less than 3 inches is provided between a lower edge of each of the side leg shields and the upper surface of the base with the lap bar assembly in the engaged position.

19. The vehicle of claim 18, wherein each of the side leg shields has a body extending generally parallel to a longitudinal axis of the center pedestal portion and wherein each of the bodies of the side leg shields is spaced apart from the center pedestal by a distance of at least 8 inches, whereby at least a portion of left and right legs of a passenger seated on the seat pan are positionable between the center pedestal and the side leg shields with the lap bar assembly in the engaged position.

20. The vehicle of claim 17, wherein the passenger restraint system further comprises a pair of behind-the-knee pins extending outward a distance from opposite sides of the center pedestal at locations below and aft of a front edge of the seat pan and wherein each of the behind-the-knee pins is actuated to slide from a first position when the lap bar assembly is in a disengaged position to a second position that is forward of the first position when the lap bar assembly is in an engaged position.

* * * * *